US006763551B2

(12) United States Patent
Drexl et al.

(10) Patent No.: US 6,763,551 B2
(45) Date of Patent: Jul. 20, 2004

(54) HINGE FOR A VEHICLE FLAP

(75) Inventors: Thomas Drexl, Munich (DE); Anton Kieferl, Schweitenkirchen (DE); Ulrich Koestler, Hebertshausen (DE); Juergen Mayr, Freising (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 09/877,245

(22) Filed: Jun. 11, 2001

(65) Prior Publication Data

US 2002/0020037 A1 Feb. 21, 2002

(30) Foreign Application Priority Data

Jun. 9, 2000 (DE) ..... 100 28 694

(51) Int. Cl.[7] ..... E05D 7/10
(52) U.S. Cl. ..... 16/266; 16/241; 16/247
(58) Field of Search ..... 16/239, 266, 241, 16/247, 248

(56) References Cited

U.S. PATENT DOCUMENTS

| | | | | |
|---|---|---|---|---|
| 948,073 | A | * | 2/1910 | Olson et al. |
| 1,602,754 | A | * | 10/1926 | Delbridge |
| 2,775,478 | A | * | 12/1956 | Stimetz et al. |
| 2,893,764 | A | * | 7/1959 | Ferguson |
| 2,915,780 | A | * | 12/1959 | McClure |
| 2,963,734 | A | * | 12/1960 | Huget |
| 2,968,830 | A | * | 1/1961 | Urtis |
| 4,030,161 | A | * | 6/1977 | Loikitz ..... 16/284 |
| 4,528,178 | A | * | 7/1985 | Babb ..... 210/645 |
| 4,584,009 | A | * | 4/1986 | Adachi et al. ..... 504/117 |
| 4,631,777 | A | * | 12/1986 | Takimoto ..... 16/312 |

FOREIGN PATENT DOCUMENTS

| | | |
|---|---|---|
| DE | 1970898 | 10/1967 |
| DE | 3401245 | 7/1985 |
| DE | 3414401 | * 10/1985 |
| DE | 3637244 | 4/1988 |
| DE | 19633152 | 2/1998 |

* cited by examiner

*Primary Examiner*—Thomas B. Will
*Assistant Examiner*—Thomas A. Beach
(74) *Attorney, Agent, or Firm*—Crowell & Moring LLP

(57) ABSTRACT

Hinge, particularly for a vehicle flap, having two hinge parts and an axle bolt which, axially inserted into aligned openings in the hinge parts, forms a swivelling axis for the hinge parts. One hinge part is in areas axially arranged either between two legs of the other hinge part or in each case between an axial supporting shoulder of the axle bolt and of the other hinge part. At least two axially adjacent surfaces of the two hinge parts or of one hinge part and of the axle bolt, which are mutually adjusted during the swivelling of at least one hinge part, are sloped in the same direction with respect to an ideal plane perpendicular to the swivelling axis of the axle bolt, whereby, in one angular position, the two hinge parts have an axial distance from one another and, in another angular position, the two hinge parts have no distance from one another or have a smaller axial distance from one another.

25 Claims, 2 Drawing Sheets

HINGE FOR A VEHICLE FLAP

This application claims the priority of German Patent Document 100 28 694.1, filed Jun. 9, 2000, the disclosure of which is expressly incorporated by reference herein.

BACKGROUND AND SUMMARY OF THE INVENTION

The invention relates to a hinge, particularly for a vehicle flap, having two hinge parts and an axle bolt which, axially inserted into aligned openings in the hinge parts, forms a swivelling axis for the hinge parts. A section of one of the hinge parts is axially arranged either between two legs of the other hinge part or in each case between an axial supporting shoulder of the axle bolt and of the other hinge part.

A hinge of this type is shown, for example, in German Patent Document DE 196 33 152 A1 and is constructed as a demountable tailgate hinge of a motor vehicle. One half of the hinge, in particular, is connected in a permanent manner with the rear flap and the other half of the hinge is detachably fastened to the rearward roof cross member by means of detachable fastening devices and an auxiliary plate. After the release of a fastening device, the hinge half assigned to the roof cross member can be removed from the roof cross member and the auxiliary plate which remains connected with the roof cross member. So that, during the new mounting of the temporarily removed hinge half, another positionally accurate placing is implemented with respect to the auxiliary plate and the roof cross member, the removed hinge half and the auxiliary plate have two mutually spaced guiding devices which, when the two parts approach one another, permit a mutual centering. Because of the auxiliary plate and the guiding devices, the manufacturing of the hinge requires high expenditures and costs. When the hinge is constructed to be largely without axial play, the axle bolt would be non-detachably riveted to the hinge parts.

It is an object of the invention to provide a hinge of the above-mentioned type, in which the hinge parts can easily be separated from one another and can later be reconnected.

This object is achieved, in certain preferred embodiments of the invention, by way of at least two axially adjacent surfaces of the two hinge parts or of one of the hinge parts and of the axle bolt, which are mutually adjusted during the swivelling of the hinge, are sloped in the same direction with respect to the swivelling axis of the axle bolt, whereby, in one angular position, the two hinge parts have an axial distance from one another and, in another angular position, the two hinge parts have no distance from one another or have a smaller axial distance from one another. Advantageous embodiments of the invention are contained in the subclaims.

In certain preferred embodiments, when mounting a frontal or rear flap provided on a motor vehicle, the hinges permitting a swivelling movement of the frontal or rear flap can optionally be mounted in a precise position in the body shell. In this case, the two hinge parts can each be adjusted in a corresponding precise position, for example, on a flange area and can be connected with the assigned wall area, for example, on the one hand, with the motor vehicle body and, on the other hand, with the frontal or rear flap by way of corresponding fastening devices.

The two hinge parts of the hinge are swivellably connected by way of an axle bolt which, at least after a first mounting of the hinge, can be axially removed from the aligned openings in the hinge parts. An axial removal of the axle bolt and thus a separating of the hinge parts after a positionally precise mounting of the hinge can be useful, for example, when the part connected with a hinge half, such as a lower rear flap part of a rear flap with two oppositely swivellable rear flap parts, represents an obstruction during the mounting of additional components particularly in the interior of the motor vehicle.

When mounting additional components, for example, in a trunk, or the like, which can be closed by the rear flap, the rear flap or a rear flap part may also be interfering when the rear flap or the rear flap part is open. After the mounting of these additional components or, for example, after a separate surface treatment of parts, the two hinge parts can be reconnected in a particularly simple manner.

Since the axially adjacent surfaces of the two hinge parts or of one hinge half and of the axle bolt are sloped in the same direction with respect to an ideal plane perpendicular to the swivelling axis and, as a result, have an axial distance from one another which depends on the angular position of the two hinge parts with respect to one another, it is possible to select a favorable angular position for the new connecting of the two hinge parts in which the axially adjacent surfaces have a sufficiently large or maximal distance from one another and therefore facilitate an approaching of the hinge parts also in the case of a mechanical or mechanically supporting mounting of the hinge parts or of the parts connected therewith. When the two hinge parts fastened to assigned parts at the favorable angular position are moved into a position in which the openings constructed therein are aligned, subsequently the axle bolt can be fitted or screwed into the aligned openings, in which case possibly a protection against torsion or a knurling on a circumferential area of the axle bolt sufficiently secures the latter with respect to a hinge part. The sloping and the axial spacing of the axially adjacent surface in the favorable angular position can be selected such that the two hinge parts, when the frontal or rear flap is then closed, preferably have no or only a slight axial distance from one another.

In the gap between the axially adjacent surfaces, a spring element, such as a cup spring, can be arranged which, in a defined angular position, causes a frictional force on these surfaces which fixes the position of the hinge parts with respect to one another or damps the movement of the hinge. The hinge can be used for single-shear or multiple-shear, for example, two-shear hinges.

Other objects, advantages and novel features of the present invention will become apparent from the following detailed description of the invention when considered in conjunction with the accompanying drawings.

DETAILED DESCRIPTION OF THE DRAWINGS

Figure 1:
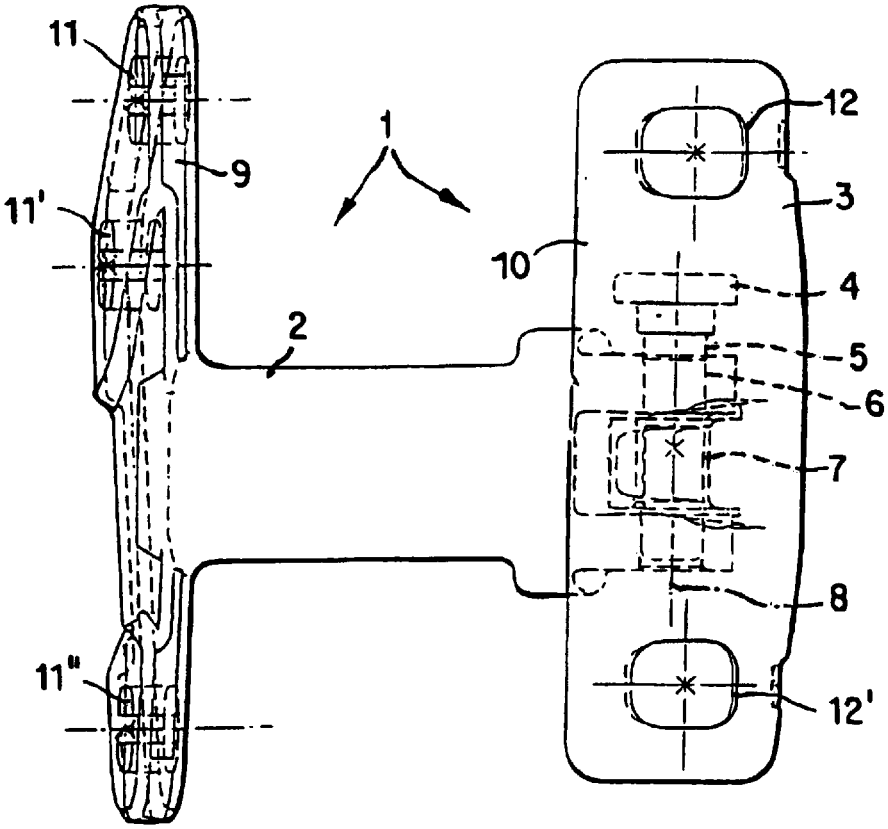
FIG. 1 shows a view of the hinge in the installed position.

Together with a second, not shown hinge of the same construction, hinge 1 illustrated in FIG. 1 is provided for supporting a rear flap of a motor vehicle, these hinges forming a joint swivelling axis 8 in a laterally symmetrically opposite manner. The hinge 1 has two hinge parts 2, 3 and an axle bolt 4 which, by way of a cylindrical area 5, is fitted into axially aligned recesses 6, 7 in the two hinge parts 2, 3 and whose center axis forms the swivelling axis 8 of the two hinge parts 2, 3. The two hinge parts 2, 3 each have a fastening flange 9, 10 which is in each case provided with fastening openings 11, 11', 11" and 12, 12' penetrated by fastening devices which connect the corresponding fastening flange 9, 10 with the assigned component—in the present case, on the one hand, with the vehicle body and, on the other hand, with the rear flap. In the defined directions or, for example, in at least one direction, the fastening openings 11, 11', 11" and 12, 12' are dimensioned to be larger than the fastening devices, so that the fastening flanges 9, 10 can be adjusted in the precise position in at least one defined direction.

Figure 2:
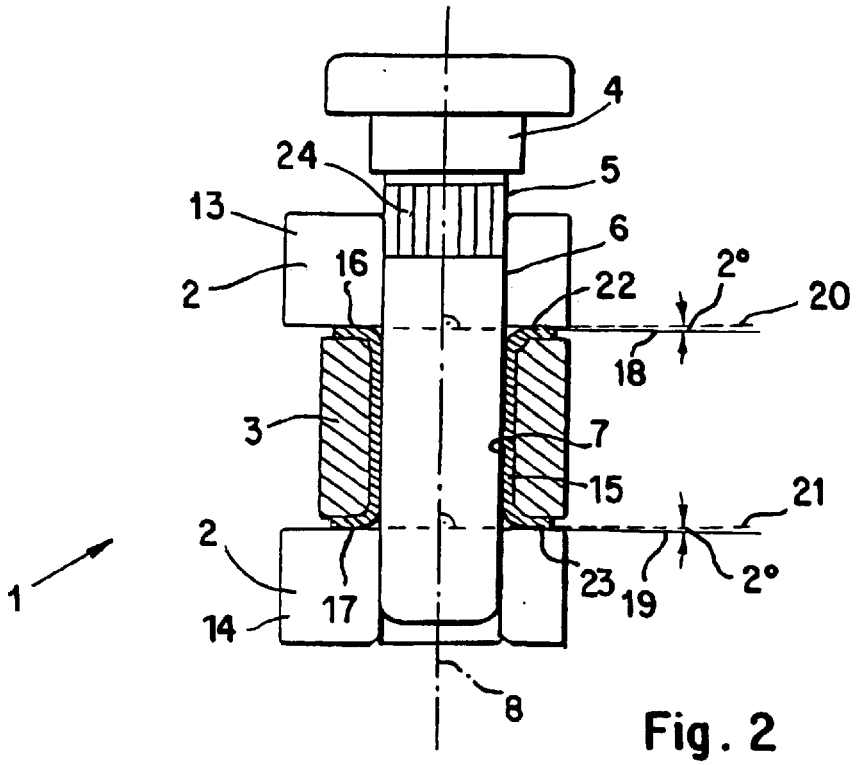
FIG. 2 shows a sectional view of the swivelling axis of the axle bolt.

FIG. 2 is a cross-sectional view of the axle bolt 4 which shows additional details. An area of the hinge part 3 is arranged axially between two legs 13, 14 of the other hinge part 2. The opening 7 in the hinge part 3 is formed by a bush 15 which is pressed together with the hinge part 3 and which radially supports the axle bolt 4 on the interior circumference. The bush 15 is non-rotatably connected with the hinge part 3 and has collars 16, 17 which protrude on the face side and which each form a face-side surface 18, 19, which surfaces 18, 19 are sloped with respect to an ideal plane 20, 21 perpendicular to the swivelling axis 8 of the axle bolt 4.

In certain preferred embodiments, the surfaces 18, 19 are sloped in the same direction and extend in parallel. The interior surfaces 22, 23 of the legs 13, 14 on the hinge part 2, which are situated opposite the surfaces 18, 19, are also sloped in the same direction as the surface 18, 19 of the bush 15 and are mutually parallel. As a result of the slope of the interior surfaces 22, 23 of the legs 13, 14 and of the surfaces 18, 19 of the bush 15, an axial distance is created between the respective adjacent surfaces 18, 22 and 19, 23 which is a function of the angular position of the two hinge parts 2, 3 about the swivelling axis 8.

Figure 4:
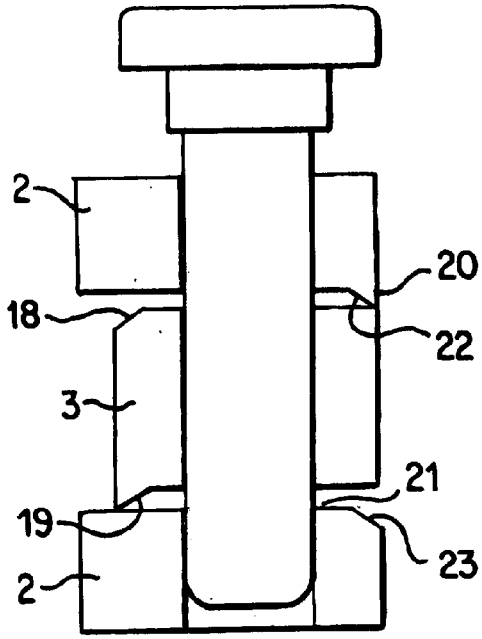
FIG. 4 shows a schematic representation of the hinge rotated out of the other angular position with slope and axial distance exaggerated.

The slope of the respectively parallel surfaces 18, 19 and the interior surfaces 22, 23 is selected such that, after the separation of the two hinge parts 2, 3 by the axial removal of the axle bolt 4 from the aligned openings 6, 7, for example, after the mounting of additional components, during which the part connected with a hinge part 2 or 3, in the present case, the rear flap or a rear flap part of the motor vehicle, would represent an obstruction, a new connection of the two hinge parts 2, 3, preferably at a defined favorable angular position, is facilitated in that, in this angular position, the sum of the axial distances between the respective adjacent surfaces 18, 22 and 19, 23 has a sufficiently high or maximal value. In this favorable angular position, as shown in FIG. 4, the two hinge parts 2, 3 can easily be joined to one another until the openings 6, 7 constructed therein are aligned, and the axle bolt 4 can again be fitted into the aligned openings 6, 7 in an application position.

The axle bolt 4 has a knurling 24 on a circumferential area, which knurling 24, in the application position, engages at least in areas axially in the opening 6 constructed in the leg 13 and, as a result, is non-rotatably connected with the leg 13. When the rear flap is subsequently closed, the respectively parallel surfaces 18, 19 and the interior surfaces 22, 23, arrive in the illustrated other angular position, in which no distance or almost no distance exists between the adjacent surfaces 18, 22 and 19, 23. In this other angular position, the parallel surfaces 18, 19 also extend approximately parallel to the parallel interior surfaces 22, 23. In this manner, an axial play between the two hinge parts 2, 3 is largely prevented in the closed position of the rear flap. The angle of slope of the parallel surfaces 18, 19 and of the interior surfaces 22, 23 with respect to the ideal plane 20 and 21 perpendicular to the swivelling axis amounts to approximately 2 degrees or between 1 to 3 degrees.

Figure 3:
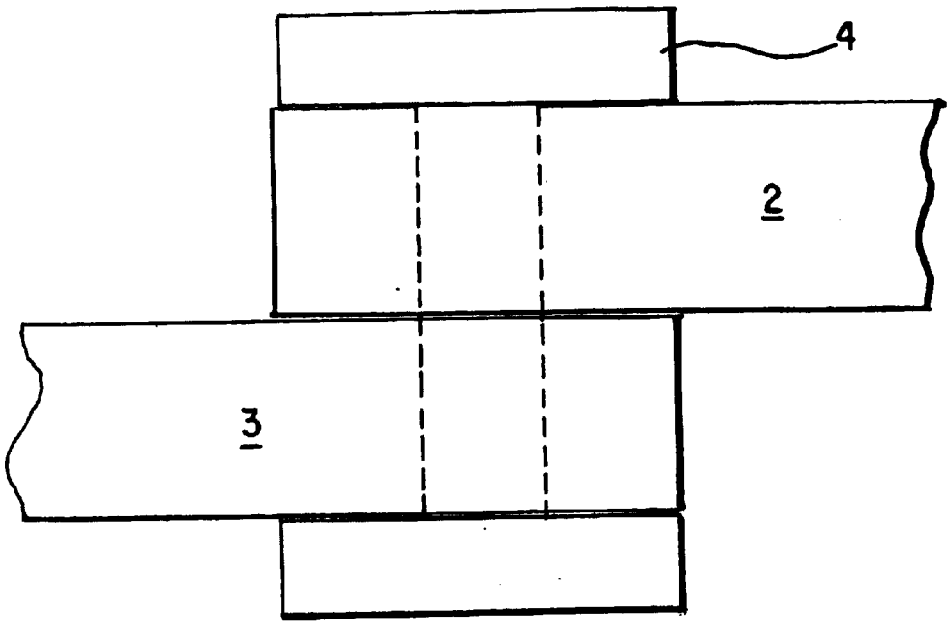
FIG. 3 shows a schematic representation of another embodiment of the hinge.

In the case of the above-described two-shear hinge, respectively axially adjacent surfaces at two points are constructed to be sloped with respect to an ideal plane perpendicular to the swivelling axis. Likewise, surfaces which are axially adjacent only at one point may have such a slope. In the described embodiment, the axially adjacent surfaces of the two hinge parts are each constructed on a face area of the corresponding hinge part which extends radially to a cylindrical circumferential area of the axle bolt. The axially adjacent surfaces may also have a radial distance from the axle bolt. In addition to a two-shear construction of the hinge, a multiple-shear or single-shear construction can be provided. In the case of a single-shear construction, as in FIG. 3, an axial face area of the axle bolt, together with a corresponding area on a hinge part, forms the axially adjacent areas which are constructed to be sloped with respect to an ideal plane perpendicular to the swivelling axis.

Between the axially adjacent surfaces, a spring element 25 may be arranged which is tensioned or relaxed when the two hinge parts are mutually swivelled and, as a result causes a friction force at the adjacent sloped surfaces which is a function of the angular position. In any angular position in an angle adjusting range of the hinge parts, the spring element may be maximally or minimally tensioned or relaxed and, as a result, cause in this angular position a maximal or minimal friction at the mutually sloped surfaces.

In all embodiments, the axle bolt is detachably connected with a hinge part at least after a first mounting. After another mounting of the axle bolt, the latter is preferably also detachably connected with a hinge part. Also, after another mounting, the axle bolt can be non-detachably connected with an assigned hinge part.

If two axially adjacent surfaces respectively are provided at several points, for example, at two points, in certain preferred embodiments and if, as a result, two surfaces are opposed on a hinge part, these surfaces are preferably constructed parallel because, in this case, these surfaces can be molded on particularly simply without cutting, or can be produced in a cutting operation. However, basically, these surfaces can also be arbitrarily sloped with respect to one another on a hinge part.

The axially adjacent surfaces preferably have a flat construction. However, an uneven construction of one surface or of the two axially adjacent surfaces is also conceivable. Any component, such as a frontal flap or a rear flap of a motor vehicle, can be swivellably supported by way of the hinge.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Hinge for a flap having two hinge parts and an axle bolt which, axially inserted into aligned openings in the hinge parts, forms a swivelling axis for the hinge parts, a section of one of the hinge parts being axially arranged either between two legs of the other hinge part or in each case between an axial supporting shoulder of the axle bolt and of the other hinge part, wherein at least two axially adjacent surfaces of the two hinge parts or of one of the hinge parts and of the axle bolt, which are mutually adjusted during the swivelling of the hinge, are sloped radially in the same direction with respect to the swivelling axis of the axle bolt, whereby, in one angular position, the two hinge parts have an axial distance from one another and, in another angular position, the two hinge parts have no distance from one another or have a smaller axial distance from one another, and wherein the axially adjacent surfaces of the hinge parts or of said one of the hinge parts and of the axle bolt have a flat construction and are sloped at an angle of approximately 1° to 3° with respect to an ideal plane perpendicular to the swivelling axis.

2. Hinge according to claim 1, wherein the axially adjacent surfaces are each constructed on a face area of the corresponding hinge part or of the axle bolt which extends radially to a cylindrical circumferential area of the axle bolt.

3. Hinge according to claim 1, wherein the hinge at at least two points between the two hinge parts or said one of the hinge parts and the axle bolt has two axially adjacent surfaces respectively which are sloped in the same direction with respect to the swivelling axis of the axle bolt.

4. Hinge according to claim 2, wherein the hinge at at least two points between the two hinge parts or said one of the hinge parts and the axle bolt has two axially adjacent surfaces respectively which are sloped in the same direction with respect to the swivelling axis of the axle bolt.

5. Hinge according to claim 1, wherein in a defined angular position of the hinge parts, the surfaces sloped with respect to the swivelling axis of the axle bolt extend approximately parallel.

6. Hinge according to claim 2, wherein in a defined angular position of the hinge parts, the surfaces sloped with respect to the swivelling axis of the axle bolt extend approximately parallel.

7. Hinge according to claim 3, wherein in a defined angular position of the hinge parts, the surfaces sloped with respect to the swivelling axis of the axle bolt extend approximately parallel.

8. Hinge according to claim 1, wherein a spring element is arranged between the axially adjacent surfaces, which spring element is tensioned or relaxed during swivelling of at least one of the hinge parts in one or the other direction and, thereby, causes a friction force on the adjacent sloped surfaces which is a function of the angular position of the hinge parts.

9. Hinge according to claim 2, wherein a spring element is arranged between the axially adjacent surfaces, which spring element is tensioned or relaxed during swivelling of at least one of the hinge parts in one or the other direction and, thereby, causes a friction force on the adjacent sloped surfaces which is a function of the angular position of the hinge parts.

10. Hinge according to claim 3, wherein a spring element is arranged between the axially adjacent surfaces, which spring element is tensioned or relaxed during swivelling of at least one of the hinge parts in one or the other direction and, thereby, causes a friction force on the adjacent sloped surfaces which is a function of the angular position of the hinge parts.

11. Hinge according to claim 5, wherein a spring element is arranged between the axially adjacent surfaces, which spring element is tensioned or relaxed during swivelling of at least one of the hinge parts in one or the other direction and, thereby, causes a friction force on the adjacent sloped surfaces which is a function of the angular position of the hinge parts.

12. Hinge according to claim 8, wherein the spring element is maximally or minimally tensioned in any angular position in an angle adjusting range of the hinge parts, and thereby, in said any angular position, causes a maximal or minimal friction force at the adjacent sloped surfaces.

13. Hinge according to claim 1, wherein, at least after a first mounting of the hinge, the axle bolt is detachably inserted into the aligned openings of the hinge parts.

14. Hinge according to claim 2, wherein, at least after a first mounting of the hinge, the axle bolt is detachably inserted into the aligned openings of the hinge parts.

15. Hinge according to claim 3, wherein, at least after a first mounting of the hinge, the axle bolt is detachably inserted into the aligned openings of the hinge parts.

16. Hinge according to claim 3, wherein, at least after a first mounting of the hinge, the axle bolt is detachably inserted into the aligned openings of the hinge parts.

17. Hinge according to claim 1, wherein, in the respective opening of the hinge part arranged in areas between the two legs of the other hinge part, a bush is arranged which supports the axle bolt on an interior circumference.

18. Hinge according to claim 2, wherein, in the respective opening of the hinge part arranged in areas between the two legs of the other hinge part, a bush is arranged which supports the axle bolt on an interior circumference.

19. Hinge according to claim 8, wherein, in the respective opening of the hinge part arranged in areas between the two legs of the other hinge part, a bush is arranged which supports the axle bolt on an interior circumference.

20. Hinge according to claim 13, wherein, in the respective opening of the hinge part arranged in areas between the two legs of the other hinge part, a bush is arranged which supports the axle bolt on an interior circumference.

21. Hinge according to claim 17, wherein the bush is non-rotatably pressed together with the respective hinge part and has collars protruding on a face side, which each form a face-side surface, said surfaces being sloped with respect to an ideal plane perpendicular to the swivelling axis of the axle bolt.

22. Hinge according to claim 1, wherein each of the hinge parts is provided at a distance from the swivelling axis with a fastening flange which can be connected by way of fastening devices with an assigned wall area.

23. Hinge according to claim 8, wherein each of the hinge parts is provided at a distance from the swivelling axis with a fastening flange which can be connected by way of fastening devices with an assigned wall area.

24. A hinge for a vehicle flap, comprising:

a first hinge part having at least one aligned opening and two legs, a second hinge part having at least one aligned opening and being axially arranged between the two legs of the first hinge, an axle bolt being axially inserted into the aligned openings in the first and second hinge parts and forming a swivelling axis for the first and second hinge parts, and at least two axially adjacent surfaces on the first and second hinge parts which are mutually adjusted during swivelling of the hinge, the surfaces being sloped in the same direction with respect to the swivelling axis, wherein, in a first angular position, the hinge parts have an axial distance from one another and, in a second angular position, the hinge parts have no distance from one another or have a smaller axial distance from one another.

25. A method of making a hinge for a vehicle flap, comprising:

providing two hinge parts, axially inserting an axle bolt into aligned openings in the hinge parts to form a swivelling axis for the hinge parts, and axially arranging one of the hinge parts either between two legs of the other hinge part or, in each case, between an axial supporting shoulder of the axle bolt and of the other hinge part, wherein at least two axially adjacent surfaces and of the two hinge parts or of one of the hinge parts and of the axle bolt, which are mutually adjusted during the swivelling of the hinge, are sloped in the same direction with respect to the swivelling axis of the axle bolt, whereby, in one angular position, the two hinge parts have an axial distance from one another and, in another angular position, the two hinge parts have no distance from one another or have a smaller axial distance from one another.

* * * * *